US008079420B2

(12) United States Patent
Alexandersson

(10) Patent No.: US 8,079,420 B2
(45) Date of Patent: Dec. 20, 2011

(54) SEALING DEVICE

(75) Inventor: Hans Alexandersson, Fristad (SE)

(73) Assignee: Pemtec AB, Svaneholm (SE)

( * ) Notice: Subject to any disclaimer, the term of this patent is extended or adjusted under 35 U.S.C. 154(b) by 0 days.

(21) Appl. No.: 12/801,530

(22) Filed: Jun. 14, 2010

(65) Prior Publication Data

US 2010/0252230 A1 Oct. 7, 2010

Related U.S. Application Data

(63) Continuation of application No. 11/920,541, filed as application No. PCT/SE2006/000223 on Feb. 17, 2006, now abandoned.

(30) Foreign Application Priority Data

May 26, 2005 (SE) ..... 0501190

(51) Int. Cl.
*E21B 33/12* (2006.01)

(52) U.S. Cl. ..... 166/387; 166/121; 166/202; 60/641.2

(58) Field of Classification Search ..... 166/386, 166/387, 121, 202; 60/641.2
See application file for complete search history.

(56) References Cited

U.S. PATENT DOCUMENTS

| | | | | |
|---|---|---|---|---|
| 1,687,424 | A | 10/1928 | Boynton | |
| 2,438,720 | A | 3/1948 | Smith | |
| 2,664,952 | A | 1/1954 | Losey | |
| 3,268,005 | A * | 8/1966 | Moore | 166/119 |
| 3,871,456 | A * | 3/1975 | Sizer et al. | 166/298 |
| 4,129,308 | A | 12/1978 | Hutchison | |
| 4,149,633 | A * | 4/1979 | Nilson | 206/219 |
| 5,655,756 | A * | 8/1997 | Robinson | 267/140.2 |
| 6,581,682 | B1 | 6/2003 | Parent et al. | |
| 7,234,314 | B1 | 6/2007 | Wiggs | |
| 7,343,753 | B2 | 3/2008 | Kidwell et al. | |

(Continued)

FOREIGN PATENT DOCUMENTS

DE 3015172 4/1980

(Continued)

OTHER PUBLICATIONS

International Search Report for international patent application No. PCT/SE2006/000223 dated Jun. 30, 2006.

(Continued)

*Primary Examiner* — Kenneth L Thompson
*Assistant Examiner* — Yong-Suk Ro
(74) *Attorney, Agent, or Firm* — Harness, Dickey & Pierce, P.L.C.

(57) ABSTRACT

A sealing device is disclosed for separating sections inside an elongate hole with at least one duct extending inside and along the hole. The sealing device includes a first portion which is arranged, in use of the sealing device, to surround the duct and fit substantially tightly against the same, and a flexible cup-shaped second portion, which is arranged to surround the first portion and be resilient radially outwards to seal, in use, against the hole. Moreover, a method is disclosed for separating sections in an elongate hole with a duct extending inside and along the hole. A sealing device is slipped onto the duct at the intended level so that the sealing device after installation forms a cup shape around the duct. The duct and the sealing device are inserted into the hole, and the duct and the sealing device are installed at the intended level.

27 Claims, 9 Drawing Sheets

U.S. PATENT DOCUMENTS

| | | | | |
|---|---|---|---|---|
| 7,347,059 | B2 | 3/2008 | Kidwell et al. | |
| 7,363,769 | B2 | 4/2008 | Kidwell et al. | |
| 7,370,488 | B2 | 5/2008 | Kidwell et al. | |
| 7,373,785 | B2 | 5/2008 | Kidwell et al. | |
| 7,377,122 | B2 | 5/2008 | Kidwell et al. | |
| 2005/0072567 | A1 * | 4/2005 | Steele et al. | 166/272.3 |
| 2006/0151182 | A1 | 7/2006 | Slack | |
| 2007/0017243 | A1 | 1/2007 | Kidwell et al. | |
| 2008/0148758 | A1 | 6/2008 | Kidwell et al. | |
| 2008/0185122 | A1 | 8/2008 | Kidwell et al. | |
| 2008/0185135 | A1 | 8/2008 | Kidwell et al. | |
| 2008/0196859 | A1 | 8/2008 | Kidwell et al. | |
| 2008/0209933 | A1 | 9/2008 | Kidwell et al. | |
| 2008/0210402 | A1 | 9/2008 | Kidwell et al. | |
| 2009/0044958 | A1 | 2/2009 | Alexandersson | |
| 2009/0250200 | A1 | 10/2009 | Kidwell et al. | |
| 2010/0252230 | A1 | 10/2010 | Alexandersson | |

FOREIGN PATENT DOCUMENTS

| | | |
|---|---|---|
| DE | 3015172 | 10/1981 |
| DE | 3142347 | 5/1983 |
| EP | 0 400 687 | 12/1990 |
| WO | 99/43922 | 9/1999 |
| WO | WO 99/45233 | 9/1999 |
| WO | WO 0192681 | 12/2001 |
| WO | WO 2006/096833 | 9/2006 |
| WO | WO 2006/126925 | 11/2006 |
| WO | WO 2010/053424 | 5/2010 |
| WO | WO 2010/147549 | 12/2010 |

OTHER PUBLICATIONS

Written Opinion for international patent application No. PCT/SE2006/000223 dated Jun. 30, 2006.

International Search Report for international patent application No. PCT/SE2009/050774 dated Feb. 17, 2010.

Written Opinion for international patent application No. PCT/SE2009/050774 dated Feb. 17, 2010.

International Search Report for international patent application No. PCT/SE2010/050692 dated Sep. 23, 2010.

Written Opinion for international patent application No. PCT/SE2010/050692 dated Sep. 23, 2010.

Office Action for U.S. Appl. No. 11/920,541 dated Dec. 15, 2009.

* cited by examiner

SEALING DEVICE

CROSS-REFERENCE TO RELATED APPLICATIONS

This application is a continuation of U.S. patent application Ser. No. 11/920,541 filed on Nov. 16, 2007, now abandoned which is a National Stage of International Application No. PCT/SE2006/000223, filed on Feb. 17, 2006. These applications also claim the benefit of Swedish Patent Application No. 0501190-3, filed on May 26, 2005. The disclosures of each of the above applications are incorporated herein by reference.

FIELD OF THE INVENTION

The present invention relates to a sealing device for separating sections inside an elongate hole with at least one duct extending inside and along the hole. Moreover the present invention relates to a method of separating sections in an elongate hole with a duct extending inside and along the hole.

BACKGROUND ART

Such sectioning or level-sealing sealing devices are known. They are used to separate different levels in a borehole in rock, which borehole should be used, for instance, as energy well or water well. Surface water can flow into such holes and contaminate, for example, drinking water so that it tastes of earth or carries contaminants from surface water. Moreover, different layers at different levels in rock can be punctured and short-circuited via the hole. This may result in the water in the hole being contaminated or other holes being contaminated via these rock layers so that undesirable effects occur, such as contamination or pressure drop. For instance, salt deposits at a depth of 100 m can easily contaminate a water well and make the water unfit for human use. An energy well is usually between 100 and 200 m deep. Normally at least one sealing device is to be used to seal against inflowing surface water, but a plurality of sealing devices may just as well have to be used for sealing at different levels in the hole.

The prior-art sealing devices that have been used up to now must, however, be specially adjusted to each hole since the quality of the rock around the hole determines whether the hole will be even and straight or whether, for instance, the hole will be slightly larger than intended since the surface of the hole has poor cohesion and will be rough. In addition, harder or smoother kinds of rock enclosed in an otherwise uniform rock may result in the hole, when being drilled, not extending perfectly straight. Moreover the drill bit is gradually worn away in use and will obtain a smaller diameter. This results in a reduction of the diameter of the hole as well.

The prior-art sealing devices are often made of PE material by turning in a lathe. All in all, this means that the sealing of the hole will be very labour-intensive and thus very expensive. Drilling in rock is in itself an expensive process and consequently this does not make installation less expensive.

SUMMARY OF THE INVENTION

The object of the present invention is to at least partly eliminate the above problems. According to a first aspect of the invention, this object is achieved by a sealing device for separating sections inside an elongate hole with at least one duct extending inside and along the hole. The sealing device comprises a first portion which is arranged, in use of the sealing device, to surround said duct and fit substantially tightly against the same, and a flexible cup-shaped second portion, which is arranged to surround said first portion and be resilient radially outwards so as to seal against said hole in use.

The sealing device between the wall of the hole and the duct, which is not to be sealed but continuously extend inside and in the longitudinal direction of the hole, provides sectioning of the hole. This sectioning thus aims at sealing parts of the hole that do not have sufficient tightness to the surroundings. The tightness may be required on the one hand to liquid and/or particles flowing through the ends of the hole and, on the other hand, to liquid flowing through the walls of the hole.

By the second part of the sealing device being resilient radially outwards from the duct, the sealing device expands against the wall of the hole. This, together with the arrangement of the first part of the sealing device to fit tightly around the duct, makes it possible for the sealing device to seal between sections in the hole. This means that it is possible to seal, that is separate different sections or levels inside the hole so that, for instance, contaminants from one level in the hole do not reach another level through the hole.

Instead of, as previously, having to specially adjust each sealing device to the size and shape of the hole and duct in question, it is now possible to use a sealing device which is very flexible and thus adjustable in shape and position. This makes it easier for the user and in the end requires less expenses.

In one embodiment of the invention, the second portion has a thickness that decreases while simultaneously its diameter increases away from the first portion. This means that the sealing device is additionally flexible in its second portion, thus further facilitating the adaptation to the prevailing conditions of the hole. In addition, the sealing device can be turned backwards downwards in its second portion if the duct together with the sealing device should need be pulled out of the hole "oppositely to" the direction of the cup shape. This reduces the force that the user must apply to pulling out, which means that this operation is facilitated.

In one embodiment of the invention, the second portion has the shape of a truncated cone, the small diameter of the cone being arranged next to the first portion.

In one embodiment of the invention, the second portion is made of PEM material. PEM materials are light and have a rigidity suitable for the purpose. A PEM material is also weldable, which facilitates use since the duct is also often made of the same material, which means that they can be welded together to form a permanent joint if desired.

In one embodiment of the invention, the first portion comprises at least one sealing clip to additionally seal against and hold to the duct.

In one embodiment of the invention, the second portion is substantially circular. Most holes are bored and will therefore be circular. The sealing device works best if also the second portion is circular. In one embodiment of the invention, the first portion is substantially circular. For the same reason why the hole is circular, most ducts are circular, and therefore the sealing device seals best against the duct if also the first portion is circular.

In one embodiment of the invention, the second portion is substantially concentrically arranged relative to said first portion.

In one embodiment of the invention, the sealing device has a slot through said first and second portion. In this way, the sealing device can be slipped onto the duct in any position along its extent and thus does not have to be slipped on from the end of the duct. This facilitates use since many ducts are long and the number of sealing devices required may be uncertain. Without the slot, the duct would therefore need to be cut to allow another sealing device to be slipped on and then be assembled once more, for instance by welding.

The object of the present invention is also achieved according to a second aspect of the invention by a sealing device for separating sections inside an elongate hole with at least one duct extending inside and along the hole. The sealing device comprises a first portion which is arranged, in use of the sealing device, to surround said duct and fit substantially tightly against the same, and a flexible second portion, which is arranged to surround said first portion to seal in use, on its outer side facing away from said first portion, against said hole. The second portion is thin relative to its outer diameter and the length of the sealing device is such that the sealing device in use extends continuously substantially all the way to the mouth of the hole. By the second portion being thin, it will be flexible and can be adjusted to the shape of the surrounding hole. By the sealing device extending all the way to the mouth of the hole, one sealing device is enough. Prior-art systems usually require a separate system for the parts of the hole which are surrounded by stable material such as rock, while looser materials such as soils or clays require more extensive reinforcement by, for example, casings of steel or plastic. This sealing device thus promotes simpler handling of sealing of holes, which in turn adds to a more economically advantageous product. At the same time, the safety for the user increases since no unnecessary joints between different sealing devices are necessary.

In one embodiment of the invention, the sealing device is made of non-rigid plastic, which is a cheap and easily accessible material.

In one embodiment of the invention, the sealing device has a thickness of 0.5-1.5 mm, which makes it light in terms of weight while at the same time it is easy to handle and flexible.

In one embodiment of the invention, the sealing device has a diameter which in use substantially matches the diameter of the hole.

In one embodiment of the invention, the sealing device is made as a continuous cylinder. This can thus be shortened to a length suitable for the application.

The object of the present invention is also achieved according to a third aspect of the invention by a kit comprising a tube and a sealing device according to the second aspect of the invention, wherein said sealing device surrounds said tube and is arranged to fit tightly against the same at a level which in use of the kit is positioned below a level imagined for sealing in an elongate hole.

In one embodiment of the invention, the kit also comprises a sealing device according to the first aspect of the invention, wherein the sealing device according to the second aspect of the invention is arranged to surround in a tight-fitting manner the outer edge of the sealing device according to the first aspect of the invention. In this manner, the two aspects of the invention are combined and the respective sealing devices can be used for sealing where they fit best in a certain application.

In one embodiment of the invention, said tube is, in its side which in use faces the bottom of the hole, arranged with a weight, wherein said sealing device is arranged to fit tightly between the tube and the weight. No extra fastening means are thus necessary for the tight connection of the sealing device to the tube.

The object of the present is also achieved according to a fourth aspect of the invention by a method of separating sections in an elongate hole with a duct extending inside and along the hole. A sealing device and said duct are inserted into said hole so that, after installation, the sealing device is positioned so as to surround said duct and form a cup shape around the same, and the duct and the sealing device are installed at the intended level.

In the same way as for the first aspect of the invention, a hole is to be sectioned by sealing between the sections, in which case, however, the through duct extends unsealed inside and in the longitudinal direction of the hole. The sealing and sectioning of the hole occur while the duct is being installed. This results in a fast and smooth mode of operation. The fact that the sealing device is installed so as to form a cup shape around the duct makes it possible to adjust the cup shape to the shape and size of the hole. Furthermore the sealing device can be made so flexible with this design that it can be turned backwards downwards when removing the duct and the sealing device from the hole again.

In one embodiment of the invention, a sealing compound is supplied to said sealing device. This additionally improves the sealing effect if desired and required.

In one embodiment of the invention, the sealing compound is adapted to expand when contacting water. This is convenient if the hole is naturally filled with water. Such holes are typically holes in the ground.

In one embodiment of the invention, the sealing compound contains montmorillonite. This is a mineral which promotes great swelling of the sealing compound, which therefore, after being supplied to the hole and the sealing device, swells greatly and improves the sealing effect.

In one embodiment of the invention, the sealing compound contains bentonite. This is a natural clay material which contains the above-mentioned montmorillonite. This means that the sealing compound will have the desired properties while at the same time it is a very cheap material.

In one embodiment of the invention, said cup shape is formed by a tube, before inserting the duct and the sealing device in the hole, being inserted into the sealing device so that the tube opens adjacent to the tight-fitting connection of the sealing device to the duct, and after installation of the duct and the sealing device in the hole, liquid is supplied through the tube so that the sealing device is expanded around the duct. This makes it possible to control how the sealing device is expanded towards the wall of the hole and efficiently seals against the same.

In one embodiment of the invention, said cup shape is formed by, after installation of the duct and the sealing device in the hole, liquid being supplied to the sealing device through its opening so that the sealing device is expanded around the duct.

In one embodiment of the invention, the hole is substantially vertically positioned. The sealing device functions well in vertical holes since gravity helps any sealing compound to fall in place in connection with installation and then also stay in place.

In one embodiment of the invention, the hole is substantially circular.

In one embodiment of the invention, the hole is a well.

In one embodiment of the invention, the hole is an energy well or a water well.

BRIEF DESCRIPTION OF THE DRAWINGS

The invention will now be described in more detail with reference to the accompanying drawings which by way of example illustrate currently preferred embodiments of the present invention.

DESCRIPTION OF PREFERRED EMBODIMENTS

Figure 1:
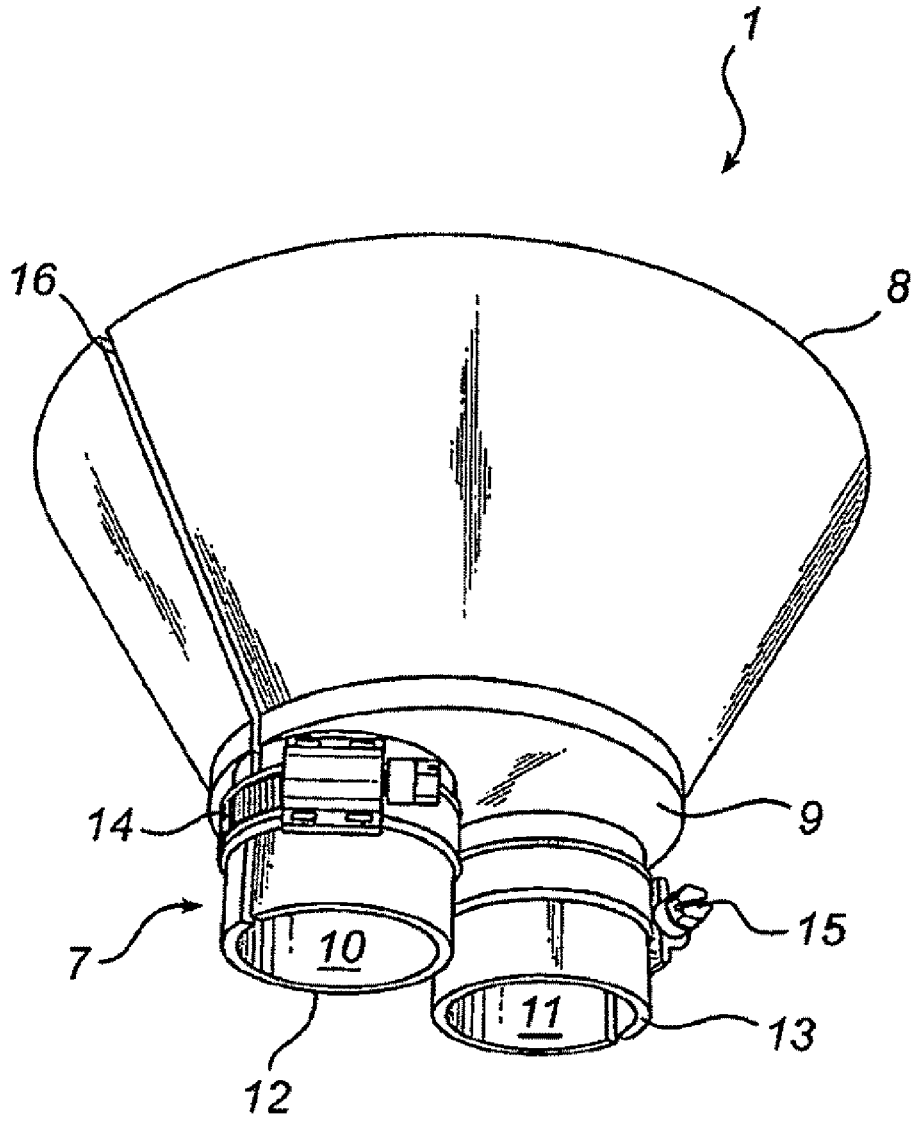
FIG. 1 is a perspective view of a sealing device according to a first embodiment of the invention.

FIG. 1 shows a sealing device 1 according to an embodiment of the present invention.

Figure 2:
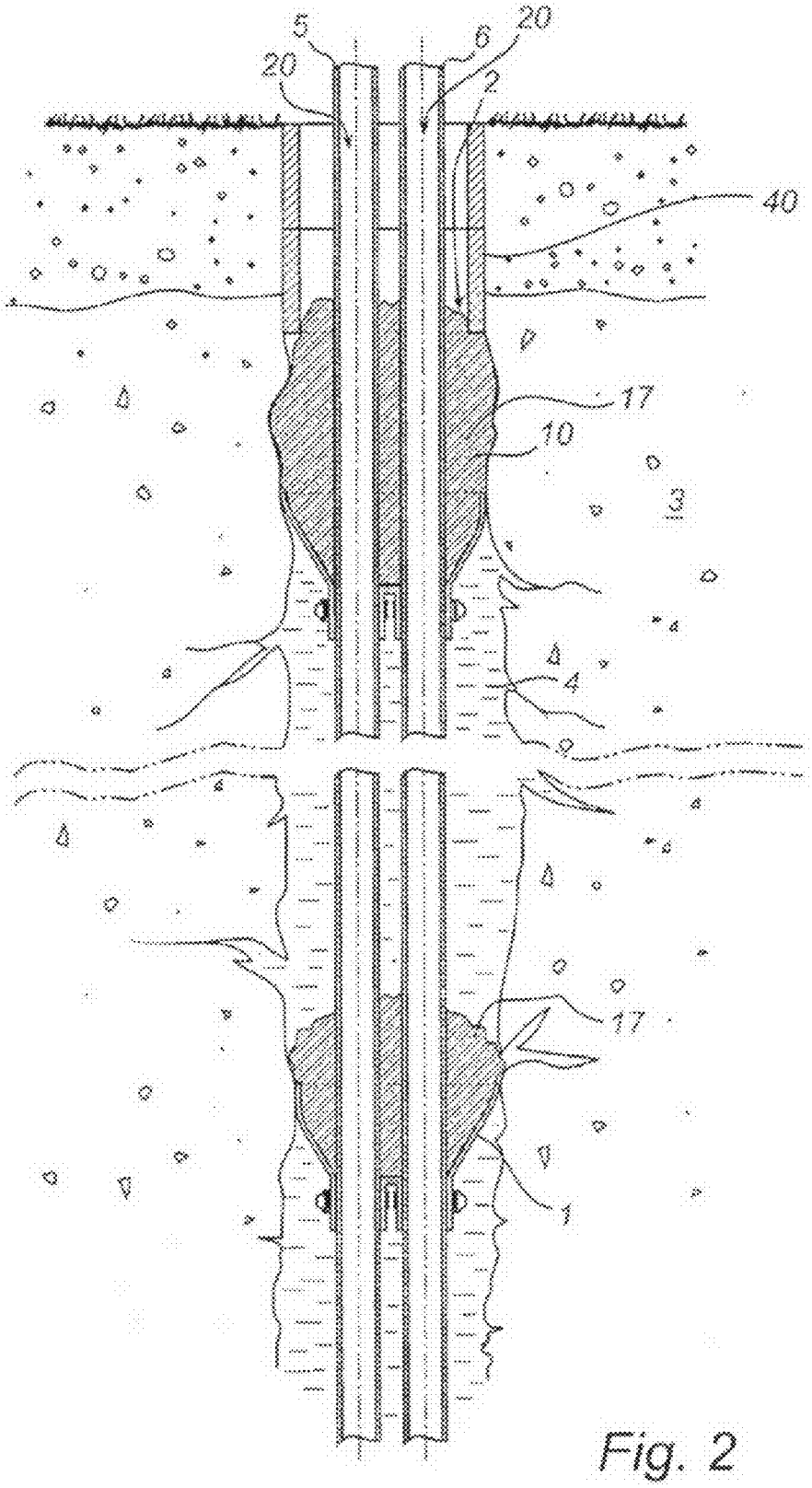
FIG. 2 is a cross-sectional view of an energy well with collector tubes provided with sealing devices according to the present invention.

FIG. 2 illustrates a vertical borehole 2 in rock 3. The borehole 2 is used as an energy well for extracting, for instance, heat for heating a house (not shown). In most cases the borehole 2 is naturally filled with groundwater 4 while being bored. Two collector tubes 5, 6 are installed in the borehole 2, one supplying 5 and the other returning 6 the cooling medium liquid 20 with which the tubes 5, 6 are filled. The cooling medium liquid 20 normally consists of water and an anti-freezing agent. It is important for the liquid of the collector tubes 5, 6 to make good contact with the surrounding rock or ground to function in a satisfactory manner and be able to take up energy to, for instance, a heat pump. The two collector tubes 5, 6 are in the bottom of the borehole 2 connected to a U-shaped connecting pipe, and a weight is attached to the connecting pipe to assist in inserting the collector tubes 5, 6 and install them in the borehole 2 at the intended level. Between ground level and the upper surface of the rock and another few metres down in the borehole 2, steel pipes, referred to as casings 40, are usually installed to shield the earth layers from the borehole 2. The vertically upper end of the casings 40 is sealed with a casing cover or seal to confine any overpressure inside the borehole 2 and to prevent the borehole 2 from being filled with soil and/or surface water. Connections to a heat pump in or connected to the house are then arranged above the borehole 2 and the steel pipes.

To seal the borehole 2 against, for instance, contaminated surface water or superficial groundwater penetrating into the deeper rock groundwater 4, or different layers at different depths in the hole 2 short-circuiting each other, thus risking that contaminants are passed on, it may be necessary to seal between different depth levels in the hole 2. This sectioning is made according to the invention by means of one or more sealing devices 1 as previously also illustrated in FIG. 1. The sealing device 1 is filled with bentonite 17 in connection with the installation in order to further increase the sealing effect. For optimum effect, the bentonite 17 can be supplied, for instance, about 3 m down in the hole 2 or, if the rock 3 is of extremely poor quality, fill the hole completely.

Referring now once more to FIG. 1, the overall shape of the sealing device resembles a truncated cone with the narrow end directed vertically downwards when installed. The sealing device 1 has a first portion 7 which is arranged at the narrow end and constitutes a seal against the collector tube 5, 6 and a second portion 8 which consists of the expanding and widening portion of the truncated cone. In the transition between the first and the second portion 7, 8, there is a plane portion 9 positioned in the truncation plane of the truncated cone. Through the plane portion 9 extend two round holes 10, 11 whose inner diameter is 40 mm, which corresponds to the outer diameter of the two collector tubes 5, 6. From each hole 10, 11 extends vertically downwards a collar 12, 13, exemplifying the preferred embodiment of the first portion 7. In the preferred embodiment, each collar 12, 13 is provided with a tube clip 14, 15 to ensure that the seal against the collector tubes 4, 5 is satisfactory.

To be slipped onto the collector tubes 5, 6, without the collector tubes needing to be cut off or lengthened in some other way, the sealing device 1 is formed with a slot 16 in the vertical direction through the first and the second portion 7, 8. In this manner, the sealing device 1 can be mounted by being opened along the slot 16 and slipped onto the collector tubes 4, 5 sideways.

Figure 4:
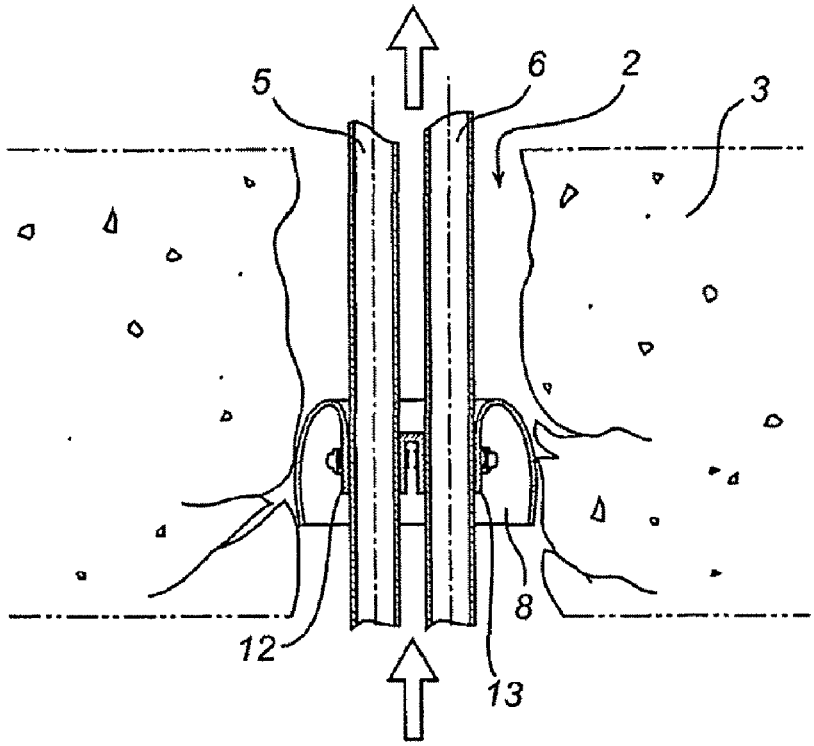
FIG. 4 is a cross-sectional view of the energy well according to FIG. 2 during removal of collector tubes and sealing devices.

The sealing device 1 is made of weldable PEM. The length of the second portion from the plane portion 9 to the outer edge of the second portion 8 at its maximum circumference is 50 mm. The length of the collars 12, 13 in the same direction is 15 mm. The diameter of the outer edge of the second portion 8 is 117 mm, and the diameter of the second portion 8 in the transition to the plane portion 9 is 100 mm. In the preferred embodiment, the thickness of the second portion 8 varies linearly between 3 mm in the transition to the plane portion 9 and practically 0 mm at its outer edge at its maximum circumference. The plane portion 9 and the two collars 12, 13 also have a thickness of 3 mm. These dimensions are adjusted to fit a collector tube 5, 6 with an outer diameter of, for instance, 40 mm and a borehole 2 with a diameter of about 115 mm. The same thickness ratio is also advantageous with, for instance, a borehole diameter of 140 mm, but in that case the outer diameter of the second portion 8 should be 144 mm. Other thicknesses are conceivable. However, the purpose of the combination of the decreasing thickness of the second portion 8 while at the same the diameter is increased and the elastic material is that the second portion 8 should be so flexible that it can easily be adjusted to the possibly varying diameter of the borehole 2 and the possibly not quite straight path of the borehole 2. In addition, the second portion 8 can be turned backwards downwards as illustrated in FIG. 4. This is advantageous if a borehole 2 and/or a collector tube 5, 6 need be repaired. Since in the normal case the sealing device 1 will be filled with bentonite 17, it would otherwise be difficult to pull the collector tubes 5, 6 together with the sealing device 1 out of the borehole 2 since in that case it would be necessary to pull out all the bentonite 17 as well. When the sealing device 1 turns backwards downwards by causing frictional forces when in contact with the wall of the borehole 2, bentonite 17 and possibly also any water 4 in the hole 2 will be allowed to pass the sealing device 1, thus making it much easier to pull out the collector tubes 5, 6 with the sealing device 1 or devices 1. Should the sealing device 1 not be filled with bentonite or some other sealing compound 17, it is still a great advantage if the second portion 8 can be turned backwards downwards since it would otherwise offer great resistance to pulling up.

To ensure a good seal between the second portion 8 of the sealing device 1 and the wall of the borehole 2, the second portion 8 is manufactured with a slightly greater maximum, that is upper, diameter than has the borehole 2. With, for example, a hole 2 with a diameter of 115 mm, the diameter of the sealing device is made to be 117 mm, and with a hole 2 with a diameter of 140 mm, the sealing device 1 is made to be 144 mm. In this way, the flexible second portion 8 can be slightly compressed and adjust to the borehole wall 2 as illustrated in FIG. 2. Furthermore the sealing device 1 can take up and ensure an adequate seal even if the borehole 2 is not entirely even, or if the rock 3 is of poor quality so that the borehole 2 will not have a whole surface.

In the preferred embodiment, bentonite is used as a sealing compound 17, as mentioned above. The reason is that this material swells greatly in contact with water 4 and thus helps to improve the sealing effect. The swelling properties are due to the material containing the clay mineral montmorillonite, which swells greatly and absorbs a large amount of water. Thus also other materials, such as habetite, can be used as an alternative to bentonite, provided that corresponding properties in terms of swelling and water absorption are achieved while at the same time the price should preferably be at a correspondingly low level. The different sealing materials 17 may, however, have different densities or forms, such as the form of powder or pellets, without affecting the sealing property. These properties instead affect handling during installation of the collector tubes 5, 6. A high density sealing compound 17 in the form of pellets flows or falls more quickly down in the hole 2 and thus more easily accompanies the collector tubes 5, 6 down in the hole 2.

Figure 3A:
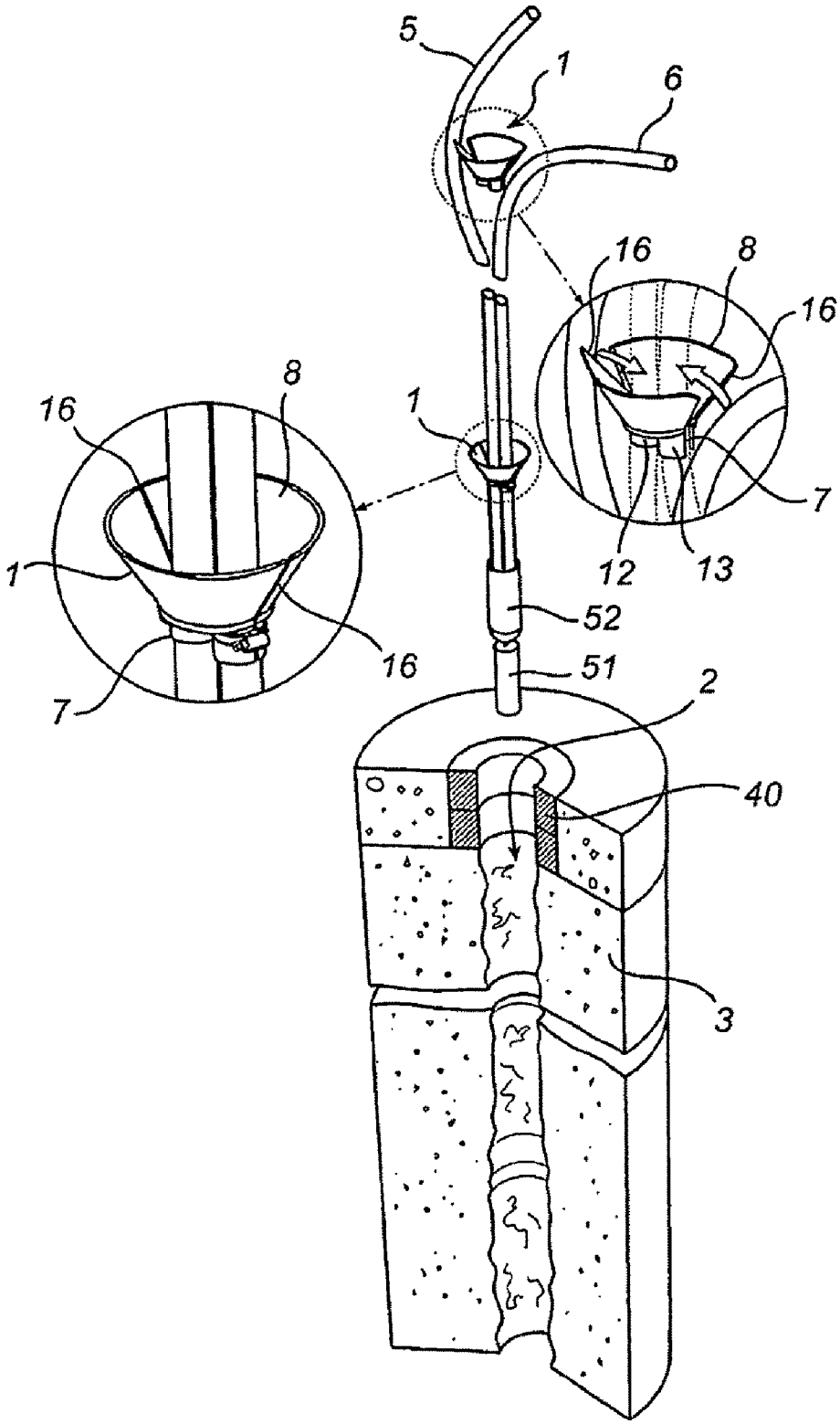
FIGS. 3*a*-3*d* are cut perspective views of the energy well according to FIG. 2 during installation of collector tubes and sealing devices.

FIGS. 3*a*-3*d* show in sequence how to install collector tubes 5, 6 together with the sealing device 1 in a borehole 2 according to the present invention. FIG. 3*a* shows the collector tubes 5, 6 above the ground, provided with suitable accessories to take up energy for a heat pump. Among other things, a protective cover 22 is fastened around the lower part of the collector tubes 5, 6 where they extend into the hole 2. A weight 51 is fixed by a bolt 53' (not shown) to the side of the protective cover 52 which faces the bottom of the hole 2, which bolt is instead to be seen in FIG. 6. A sealing device 1 is already mounted a distance down on the tubes 5, 6, and another sealing device 1 is on its way to be fixed somewhere along the extent of the tubes 5, 6. The Figure indicates by the rock 3 being cut that the hole 2 is deeper than indicated in the Figure and that the tubes 5, 6, by being cut in a similar manner, are correspondingly longer. In an alternative embodiment, however, the tubes 5, 6 can actually be cut off to fasten a sealing device 1. In that case, this sealing device 1 is not formed with a slot 16 as is the case in the preferred embodiment shown in the Figure. The sealing device 1 is slipped onto the collector tubes 5, 6 by the two slots 16 being opened so that the tubes 5, 6 can be surrounded. Subsequently the sealing device is fixed by a tube clip 14, 15 around the respective collars 12, 13 so that they are arranged in a tight-fitting manner around the respective tubes 5, 6. While the tube clips 14, 15 are being tightened, also the slots 16 are sealed by the entire sealing device 1 being pulled together. Alternatively, the sealing device 1 may have merely a slot 16 in one side and also have a slot between the collars 12 and 13 so that the collector tubes 5, 6 can be installed correctly.

Figure 3B:
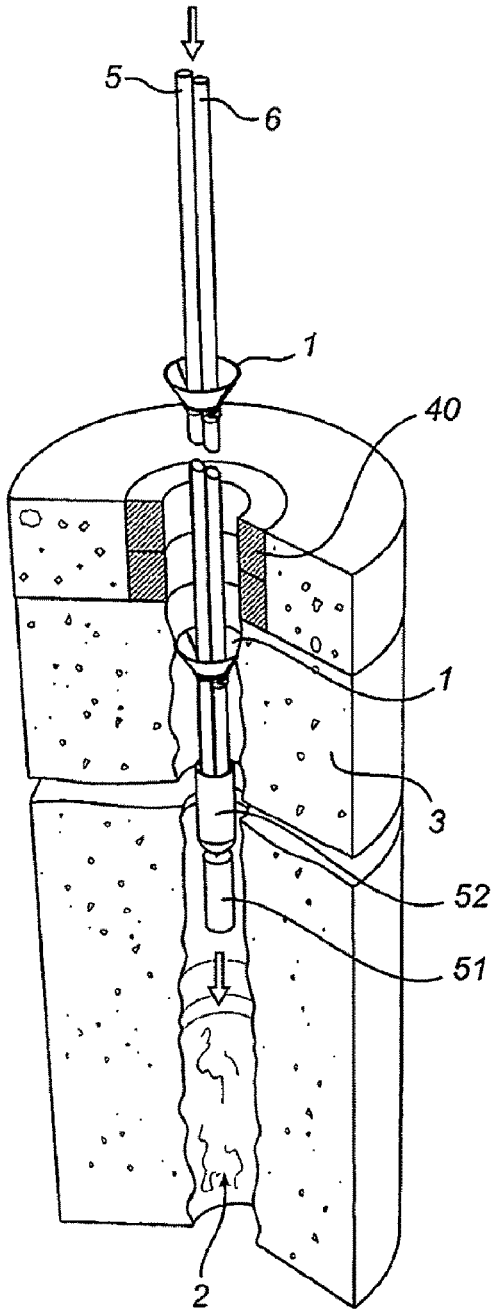

In FIG. 3*b*, the collector tubes 5, 6 are being installed and have already been inserted a distance into the hole 2.

Figure 3C:
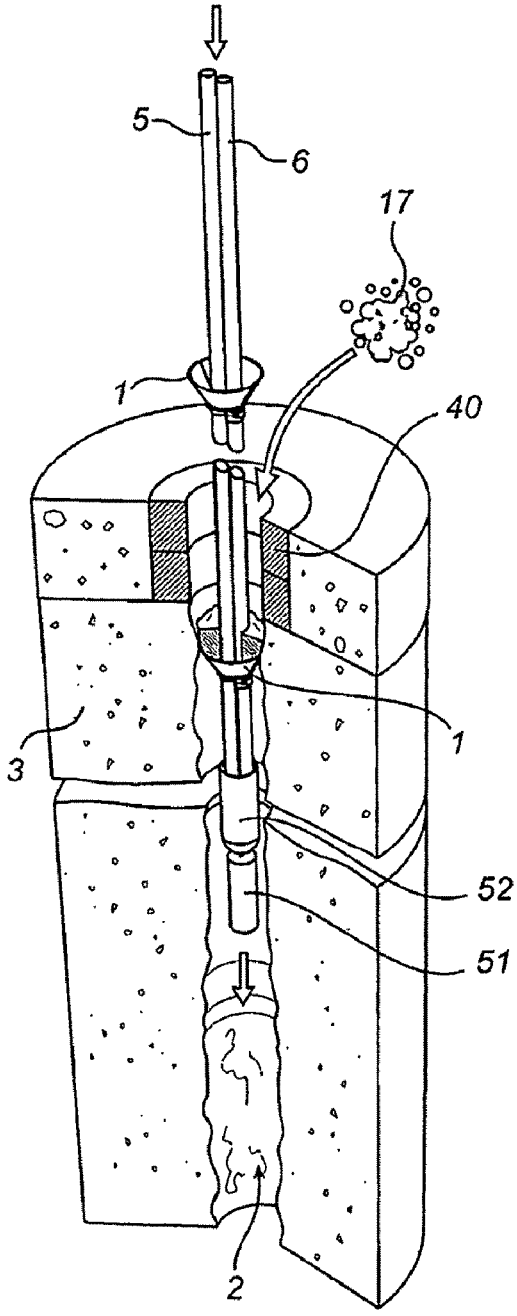

FIG. 3*c* shows the same position as in FIG. 3*b*, but here bentonite 17 is being filled into the hole 2 to make the bentonite 17 together with the surface water 4 which is to be found naturally in the hole 2, swell and additionally seal adjacent to the sealing device 1. The bentonite 17 need be supplied before the next sealing device 1 has been advanced so far that it will just extend into the hole 2.

Figure 3D:
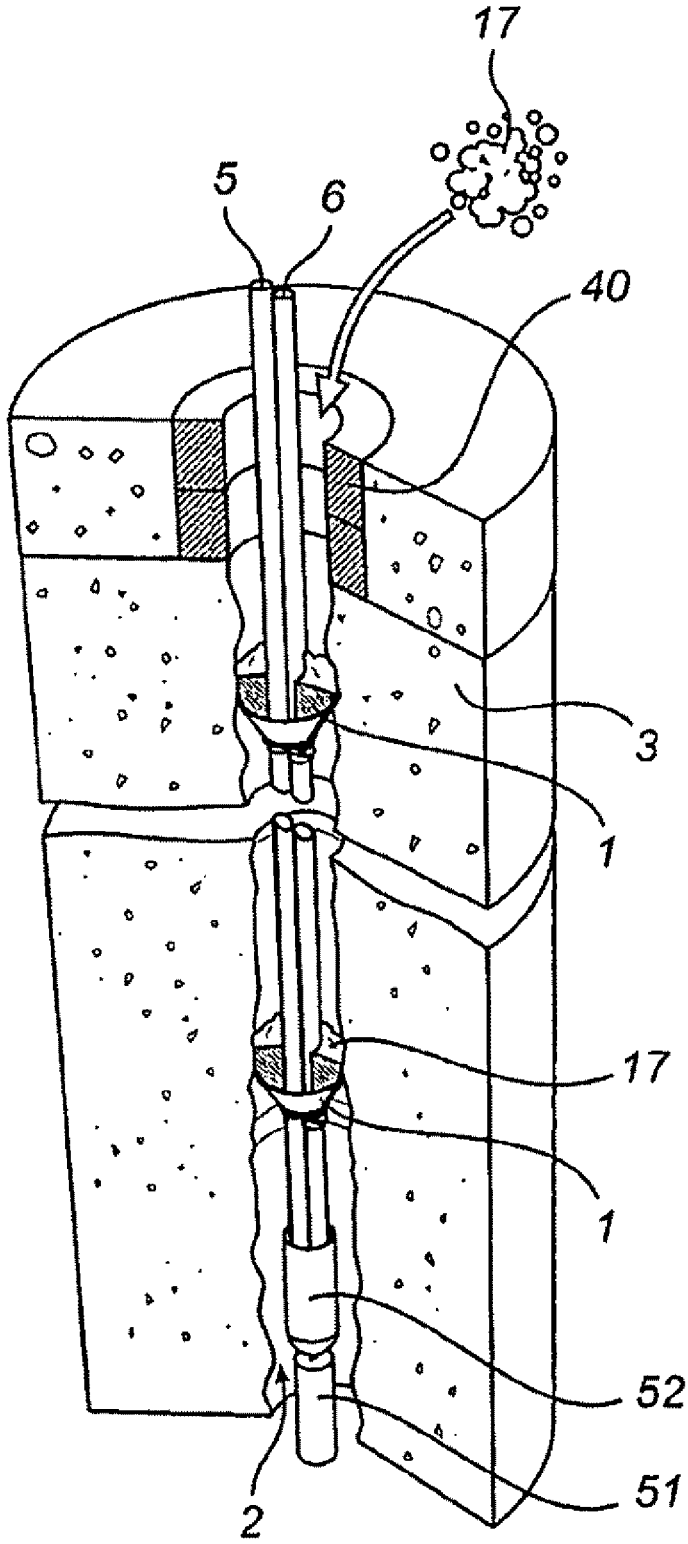

In FIG. 3*d*, the collector tubes 5, 6 have been installed at the intended level, and a last amount of bentonite 17 is supplied to the uppermost sealing device 1. The amount of bentonite 17 may vary between different holes 2, but a suitable amount may be about 3 m under Swedish conditions.

It will also be appreciated for this sealing device that many modifications of the embodiment described above are conceivable within the scope of the invention, as is also defined in the appended claims. For instance, each first portion 12, 13 can be provided with a welding sleeve for welding against the collector tubes 5, 6 instead of tube clips 14, 15. Moreover the sealing device 1 need not be slotted 16, but can be slipped onto the collector tubes 5, 6 from one end portion thereof, or by the collector tubes being cut off and the sealing device 1 being slipped on, after which the tubes 5, 6 are again welded together.

Figure 5:
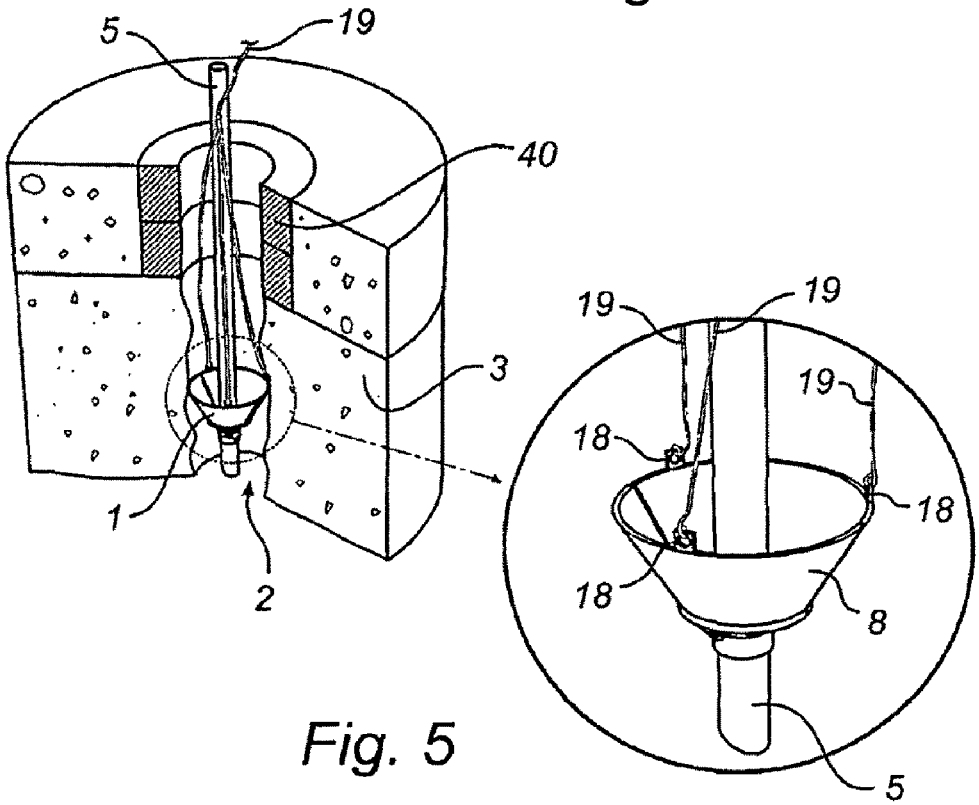
FIG. 5 is a cut perspective view of a water well with a tube and a sealing device according to the present invention.

Another interesting embodiment of the invention involves the use of the sealing device 1 for sealing in boreholes 2 which are used as water wells. This is illustrated in FIG. 5. In this case, the sealing device 1 has a duct 5 for drawing up water, and two more ducts, one for an electric cable and one for a bleeding tube. However, the two latter ducts are not shown in the Figure. Furthermore the sealing device 1 has in this embodiment a first portion 7 to surround said water suction tube 5 and said electric cable and bleeding tube. In this embodiment, there are thus usually three holes in the first portion 7 and three associated collars and tube clips. Also in this case, the sealing device 1 is used to seal the borehole 2 with rock groundwater 4 against penetrating surface water that could contaminate the drinking water. This also results in the effect that the sealing device 1 is not fully hermetically sealing since the water level 4 in the well 2 must be allowed to vary depending on the withdrawal of water. Furthermore, FIG. 5 illustrates an alternative to taking up the duct 5 by turning the sealing device 1 backwards downwards. Here, use is instead made of three loops 18, which are equidistantly fastened along the outer edge of the second portion 8. A rope 19 runs through the loops, which has an end above the ground so that the user when taking up the tube 5 can at the same time pull the rope 19 and slightly pull together the second portion 8 and pull also the sealing compound 17 out of the hole 2.

Other fields of the application for the sealing device 1 are all forms of channels through which extends a small tube in the longitudinal direction, where the channel need to be sectioned for different reasons. Nor does the channel have to be vertically directed, although this is convenient if the sealing device 1 is to be additionally sealed by a sealing compound 17 which utilises gravity. However, a sealing compound 17 can be used, which seals by oxidising after installation, or which seals by swelling in connection with heating, for instance.

The hole 2 need not be circular, but may have any shape. This also applies to the shape of the duct 5, 6. However, in that case the sealing device 1 may need to be adjusted in shape to the intended use. If either the hole 2 or the duct 5, 6 is in the shape of a polygon, for instance a hexagon, a circular sealing device 1 may yet function, provided that either the material of the sealing device 1 is sufficiently weak ("non-rigid") or the construction of the sealing device 1 is sufficiently flexible.

Figure 6:
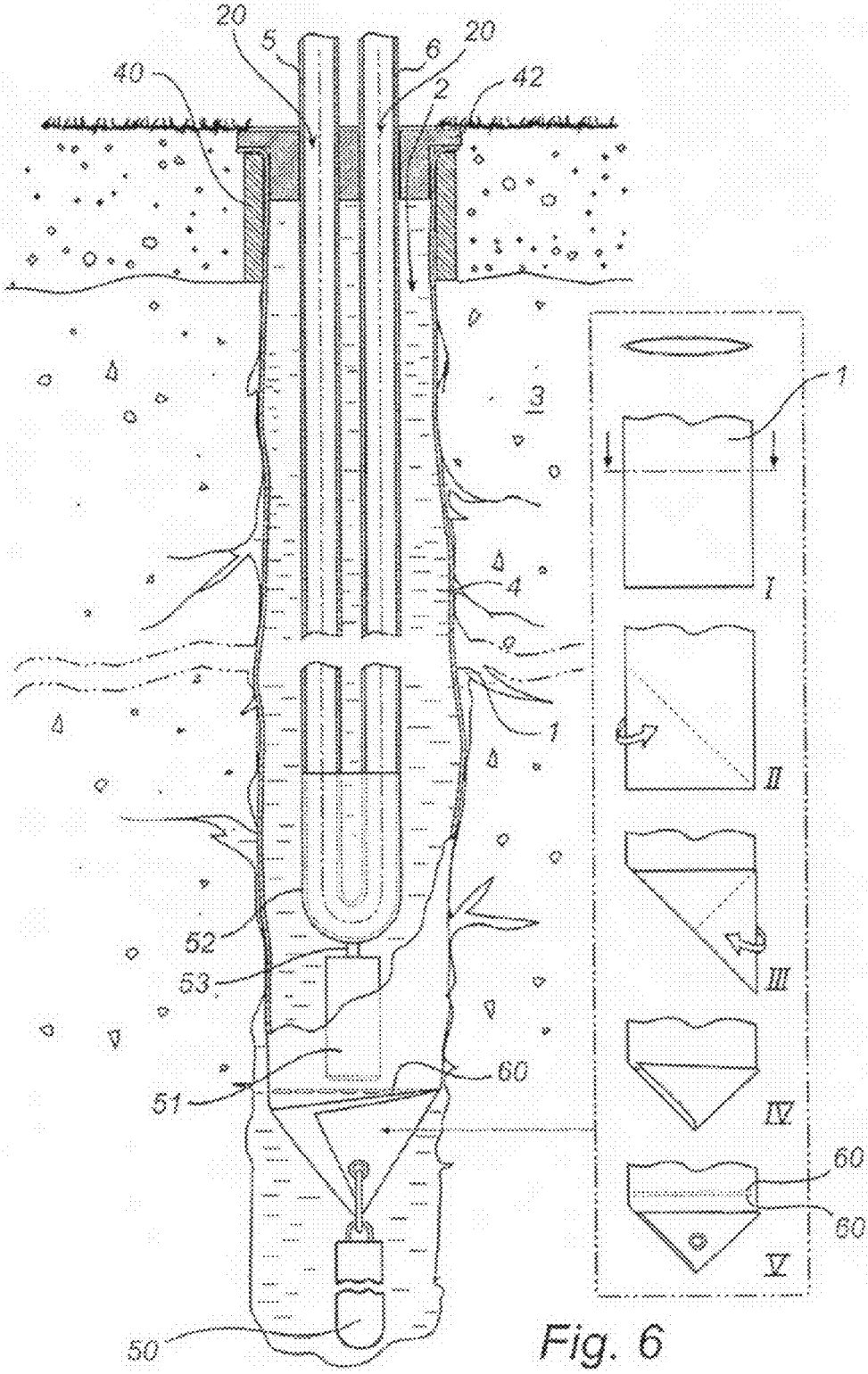
FIG. 6 is a cross-sectional view of an energy well with collector tubes provided with sealing devices according to an alternative embodiment of the present invention.
Figure 7:
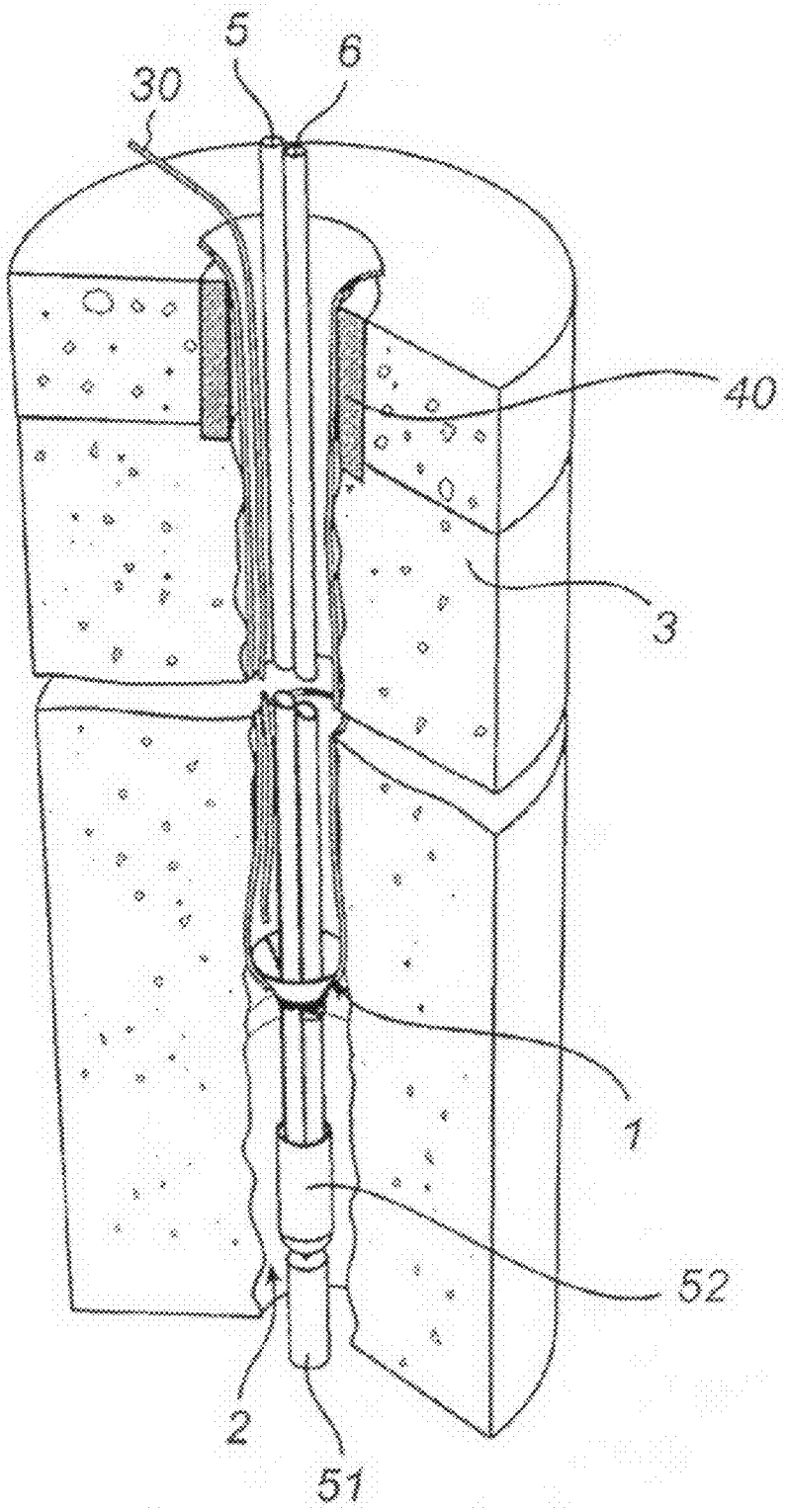
FIG. 7 is a cross-sectional view of an energy well with collector tubes provided with sealing devices according to an alternative embodiment of the present invention.

In yet another embodiment of the sealing device 1, see FIG. 6, the sealing device consists of a thin cylindrical "stocking" of non-rigid plastic, which in one embodiment of the invention is slipped onto the collector tubes 5, 6 before they are installed in the borehole 2. The length of the sealing device 1 is adjusted to extend substantially all the way up to the mouth of the hole 2 at the ground level. The reason why it may sometimes be suitable not to let the sealing device 1 open exactly at the level of the mouth of the hole 2 is that it may then be unlawfully manipulated or damaged. In these cases, a suitable level of the opening of the sealing device 1 can be adjacent to the transition between the frost level and the frost-free level, in Sweden about 1-2 m below ground level. That part of the hole which in that case is positioned above the opening of the sealing device 1 but below the mouth of the hole 2 is sealed and can then be covered with, for instance, earth. See below for a detailed description of the sealing of the sealing device 1. For instance, the sealing device 1 can be fastened in the transition between the collector tubes 5, 6 and the weight 51, at a level along the collector tubes 5, 6 if this would be desirable, or, as shown in FIG. 6, below the collector tubes and the weight 51. In the embodiment shown in FIG. 6, an additional weight 50 is fixed to the lower part of the sealing device 1. Then the sealing device 1 is filled with water, either from above or, as shown in FIG. 7, using a tube 30 inside the sealing device 1. The sealing device 1 and the weight 50 are finally inserted into the hole 2 down to the bottom thereof. After that the collector tubes 5, 6 and their weight 50 are let down into the hole 2 inside the sealing device 1. The thickness of the sealing device 1 can be adjusted to the water pressure in the borehole 2 and to the quality of rock and the ground in the borehole 2, thus preventing the sealing device 1 from being torn while being inserted into the hole 2 or when the collector tubes 5, 6 are installed in the hole 2 and the sealing device 1 is expanded against the wall of the hole 2. A suitable thickness may vary between 0.5 and 1.5 mm, but deviations may be necessary due to the circumstances, both to smaller and greater thicknesses. The sealing device 1 may be manufactured and delivered as a continuous "stocking" with a certain diameter, which is cut by the fitter to a suitable length when the borehole 2 is completed. Alternatively the sealing device can be completed in the factory. The diameter of the sealing device 1 is suitably selected to substantially correspond to the diameter of the borehole 2, thus fitting tightly against the same.

The sealing device 1 is closed at its end facing the bottom of the hole 2, FIG. 6 II, by first its open end being folded along the entire width of the sealing device 1, thus forming a triangular tab at an angle of 45° to its longitudinal extent. Subsequently the now folded edge is folded once in the opposite direction, FIG. 6 III, thus forming a triangular tab at an angle of 45° to the longitudinal extent of the sealing device 1, the tip of the triangular tab being formed along the centre line of the sealing device 1 seen in its longitudinal extent, FIG. 6 IV. A small through hole is made through this triangular tab and provided with a reinforcing ring in the form of a staple, FIG. 6 V. A cotter pin can then be passed through this staple, thus holding the sealing device 1 attached to its weight. Finally one or more lines are welded across the sealing device 1 just above the just formed fold lines, said welds ensuring that the sealing device 1 is perfectly sealed at this end.

As a rule there are two types of borehole 2: those naturally filled with water and those not filled and thus being empty. The holes 2 which from the beginning are filled with water can apply a water pressure to the installed collector tubes 5, 6 and the sealing device 1 so that a water pressure inside the sealing device 1 may have to be built up to expand the sealing device 1 against the borehole wall. This is conveniently done by passing, together with the collector tubes 5, 6 and the sealing device 1 while being installed, a water tube down in the hole 2, see FIG. 7. The water tube is arranged beside the collector tubes 5, 6 and inside the sealing device 1, which thus surrounds both the collector tubes 5, 6 and the water tube. The water tube has one opening adjacent to the tight-fitting connection of the sealing device to or under the collector tubes 5, 6 and its other opening above the ground to be connected to a suitable pump system. With these parts installed in the borehole 2, water is pumped down in the sealing device 1 through the water tube, this water thus pressing away any other water in the hole 2, so that the sealing device 1 places itself along the side of the borehole wall. In this way, different levels in the borehole 2 are sealed, thus preventing groundwater from one level in the hole from reaching another level. Also no special sealing is required of that part (in most cases the upper part) of the hole 2 that does not consist of rock but of earth and/or clay, which otherwise would normally have been sealed by means of, for instance, plastic or steel rings, referred to as casings 40. Thus this sealing device 1 makes it possible to utilise the entire borehole 2 for energy withdrawal all the way from its bottom to its opening at the ground level. Another advantage is that no surface water from the ground surface can flow down in the borehole 2 since the sealing device 1 is suitably sealed against the environment at the ground level.

After installation and filling the sealing device 1 with water, the energy well is ready for use. It is suitable for the water tube to remain in the borehole 2 since further filling with water may be required at a later stage. This water tube can also be used if it appears necessary to maintain a certain overpressure inside the sealing device 1. By mounting a pressure-sensitive transducer on the water tube and connecting the transducer to a reading system, it will be possible to continuously read the condition of the borehole 2. This information can be sent in prior-art manner either wirelessly or by appropriate wiring to a reading position, for instance, in connection with the installation for withdrawal of energy from the energy well.

In a borehole 2 which is empty from the beginning, or if the water pressure in the borehole is so low that it does not prevent the sealing device 1 from being filled with water without overpressure, it is possible to fill the sealing device 1 without water pressure from inside. Thus in this case it is not necessary, but still possible, to use a water tube according to the above method. Instead collector tubes 5, 6 and a sealing device 1 can be inserted and installed in the hole 2 as described above, after which water can be supplied through the opening of the sealing device 1 at the ground level. Even if a water tube has not been used in this case for supplying water, a pressure-sensitive transducer can still be inserted into the upper part of the borehole to monitor its condition.

Figure 8:
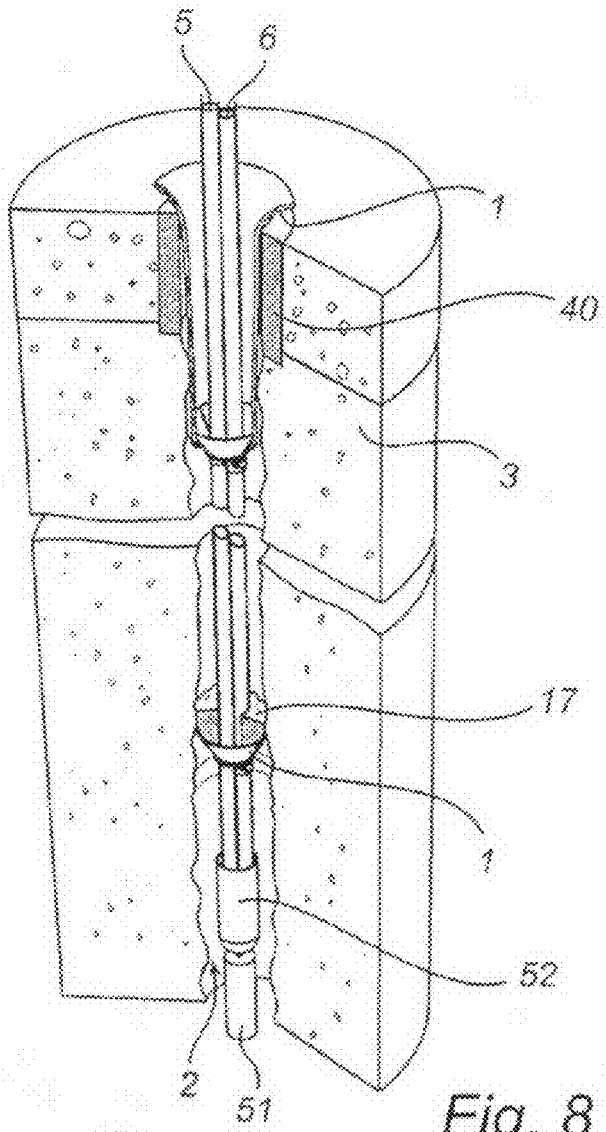
FIG. 8 is a cross-sectional view of an energy well with collector tubes provided with two embodiments of the sealing device according to the present invention.
Figure 9A:
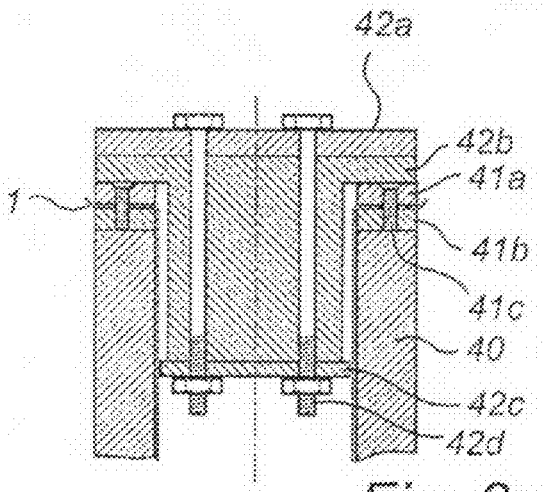
FIGS. 9*a*-9*b* are cross-sectional views in sequence of the sealing against the surroundings at the mouth of the borehole.
Figure 9B:
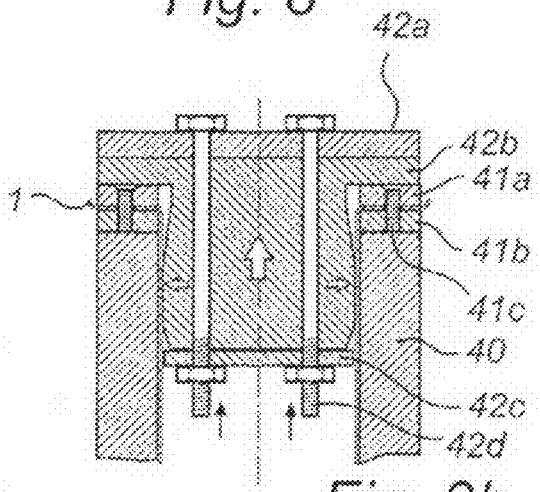

The sealing device 1 is suitably sealed at the mouth of the hole 2 in the following way, see FIGS. 9*a*-9*b*. In most cases, there is earth above the rock. Due to this earth, casings 40 are normally not necessary to stabilise the shape of the hole 2. According to Swedish standards, this casing 40 should extend at least 6 m below the upper edge of the rock to ensure a tight transition. However, this does not always occur. According to the present invention, it is no longer necessary to have casings 40 6 m down in the rock, even if the standards may still stipulate this. The seal 42 consists of two rigid steel sheets 42*a* and 42*c* between which a thick rubber plate 42*b* is mounted. The opening of the sealing device 1 is inserted between two metal rings 41*a* and 41*b* which are assembled with a screw 41*c*. The metal rings 41*a* and 41*b* have the same outer and inner diameter as the casing 40 and can therefore be placed loosely on the upper edge of the casing 41. When the metal rings 41*a* and 41*b* together with the sealing device 1 are placed on the casing 40, the seal 42 can be placed on top of the metal rings 41*a* and 41*b*. In this position, parts of the rubber plate 42*b* and the lower steel sheet 42*c* extend down into the casing 40 and the sealing device 1. Through the entire seal 42 extend 4 through bolts 42*d* which are now tightened so that the lower steel sheet 42*c* is pulled towards the upper steel sheet 42*a*, thus squeezing the rubber plate 42*b*. The rubber plate 42*b* is now pressed towards the walls of the casing 40 and presses the sealing device 1 against the same so as to form a tight closure. The embodiments of the invention illustrated in FIGS. 7 and 8 show a sealing device 1 before being provided with a seal 42.

In one variant of this form of sealing of the borehole 2, it may be convenient to combine sealing by a "cone" at a certain borehole level 2 with sealing by a "stocking" for sealing the entire level of the borehole 2 up to ground level. The cylindrical "stocking" is then attached to the outside of the "cone" in a tight-fitting manner, see FIG. 8. Subsequently, one of the above-mentioned filling methods can be used.

Other combinations of the two sealing devices 1 are conceivable. For example, one or more sealing devices 1 in the form of a "cone" filled with bentonite can be attached to the collector tubes 5, 6 and on top of that a sealing device 1 in the form of a "stocking", with or without a "cone".

The invention claimed is:

1. A sealing device for separating sections inside an elongate hole with at least one duct extending inside and along the hole, the sealing device being an elongate continuous jacket having a flexible cylindrical shape, which elongate continuous jacket is adapted to be arranged to surround the lower end of said duct and extend below the lower end of said duct, and further being adapted to in use fit against walls of the elongate hole by utilization of said flexible cylindrical shape through dilation thereof by a liquid present therewithin, wherein said sealing device is liquid impermeable while enabling energy exchange between its surrounding and interior.

2. A sealing device according to claim 1, wherein an end of said sealing device is adapted to face a bottom of said hole is closed.

3. A sealing device according to claim 2, wherein the end of said sealing device adapted to face the bottom of said hole is closed by folding.

4. A sealing device according to claim 2, wherein the end of said sealing device adapted to face the bottom of said hole is closed by welding.

5. A sealing device according to claim 1, wherein a weight is fixed to a lower part of said sealing device to lower the sealing device into the elongate hole.

6. A kit comprising at least one tube; and a sealing device according to claim 1, wherein said sealing device surrounds said tube.

7. A sealing device according to claim 1, wherein said sealing device is made of non-rigid plastic.

8. A sealing device according to claim 1, wherein said sealing device is generally of uniform thickness.

9. A sealing device according to claim 8, wherein a thickness of the sealing device is preferably between approximately 0.3 mm and approximately 1.5 mm.

10. A sealing device according to claim 8, wherein a thickness of the sealing device is preferably between approximately 0.5 mm and approximately 1.5 mm.

11. A sealing device according to claim 1, wherein said elongate continuous jacket is generally water impermeable.

12. A sealing device according to claim 1, wherein said elongate continuous jacket is adapted in use to extend essentially along the full length of said hole.

13. A system for extracting energy from a ground, the system comprising:

an elongate hole in said ground, an elongate continuous sealing jacket for separating sections of said hole and extending inside said hole and being closed at its bottom end, said sealing jacket having a flexible cylindrical shape which shape in use is utilized in order for said sealing jacket to fit against walls of said hole and surround the lower end of said duct and extend below the lower end of said duct, wherein said sealing device is pressed against the walls of said hole through dilation thereof by a liquid present therewithin, wherein said sealing device is liquid impermeable while enabling energy exchange between its surrounding and interior, and said system further comprising at least a first duct and heat recovery means, wherein said first duct is operatively connect to said heat recovery means and extending into said sealing device.

14. A system for extracting energy according to claim 13, further comprising a second duct operatively connected to said heat recovery means and extending into said sealing device.

15. A system for extracting energy according to claim 14, wherein said first and second ducts are interconnected so as to form a continuous passage.

16. A system for extracting energy according to claim 13, wherein the sealing device at ground level has a mouth which is enclosed by a casing.

17. A system for extracting energy according to claim 13, wherein the sealing device at ground level has a mouth which is closed by a seal.

18. A system for extracting energy according to claim 17, wherein said seal comprises two rigid steel sheets and a rubber plate arranged between said steel sheets.

19. A system for extracting energy according to claim 17, wherein said seal comprises two sealing rings secured to a top of a casing enclosing said sealing device at a mouth thereof at ground level, wherein said sealing device is clamped between said sealing rings.

20. A method of separating sections in an elongate hole, the method comprising the steps of:

providing a sealing device being an elongate continuous jacket having a flexible cylindrical shape adapted to be arranged to surround a duct, and inserting said sealing device and said duct into the hole, so that, after installation, the sealing device is positioned so as to surround the lower end of said duct and extend below the lower end of said duct, wherein the sealing device is configured to be pressed against the walls of said hole by utilization of said flexible cylindrical shape through dilation thereof by a liquid present therewithin, wherein said sealing device is liquid impermeable while enabling energy exchange between its surrounding and interior.

21. A method of separating sections in an elongate hole according to claim 20, the method further comprising the steps of:

inserting said sealing device in the hole; and inserting said duct into the hole inside the sealing device.

22. A method of separating sections in an elongate hole according to claim 20, the method further comprising the steps of:

inserting said duct into said sealing device; and inserting said duct and said sealing device into the hole.

23. A method of separating sections in an elongate hole according to claim 20, wherein the sealing device is pressed against walls of said hole by filling the sealing device with liquid.

24. A method of separating sections in an elongate hole according to claim 20, wherein the method further comprises the step of arranging a tube inside the sealing device, in such a manner that the tube opens adjacent to the end of said sealing device facing a bottom of said hole.

25. A method of separating sections in an elongate hole according to claim 24, wherein the sealing device is filled with liquid using said tube, so that the sealing device is pressed against the walls of said hole.

26. A method of separating sections in an elongate hole according to claim 20, wherein the sealing device is filled with liquid through its opening, after the installation of the duct and the sealing device in the hole.

27. A method separating sections in an elongate hole according to claim 20, wherein the method further comprises the step of sealing the sealing device at the mouth of the hole.

* * * * *